United States Patent [19]

Staroba

[11] Patent Number: 4,650,255

[45] Date of Patent: Mar. 17, 1987

[54] RETAINER FOR HOLDING MINERAL CUTTER IN A TOOL-BOX

[75] Inventor: Otto R. Staroba, Toronto, Canada

[73] Assignee: Ewid Limited, Downsview, Canada

[21] Appl. No.: 722,235

[22] Filed: Apr. 11, 1985

[51] Int. Cl.[4] ..... E21C 25/12; E21C 35/18

[52] U.S. Cl. ..... 299/92; 175/413; 37/142 A

[58] Field of Search ..... 299/91, 92; 37/142 A; 175/412, 413; 279/96; 407/109

[56] References Cited

U.S. PATENT DOCUMENTS 3,864,854 2/1975 Evans ..... 175/413 X 4,154,483 5/1979 Hollingworth ..... 299/92

4,261,619 4/1981 Howe et al. ..... 299/92

FOREIGN PATENT DOCUMENTS 2835410 12/1979 Fed. Rep. of Germany ..... 299/92

*Primary Examiner*—James A. Leppink

*Assistant Examiner*—Michael A. Goodwin

*Attorney, Agent, or Firm*—McCarthy & McCarthy

[57] ABSTRACT

A tool is retained in a socket of a mineral cutter by an elastomeric element acting between the shank of the tool and the wall of the socket. The element is formed with corrugations that abut the wall of the socket and oppose the forces applied to the cutter of the tool.

3 Claims, 6 Drawing Figures

RETAINER FOR HOLDING MINERAL CUTTER IN A TOOL-BOX

FIELD OF INVENTION

The present invention relates to an improved retainer means for use with mineral cutter tools. In particular the present invention discloses a novel deformable resilient member and the associated co-operating notched pick shank face of a cutter tool for maintaining a pick shank of a cutter in replaceable mode in the tool-box socket of a mineral cutting device.

PRIOR ART

It is known that where a plurality of picks or bits are set onto their shank holders to act as the cutting head of a rotary cutting machine for mining minerals and the like, the shank and its head must be easily replaceable from the socket of the tool-box when the cutting head and pick become worn or broken to prevent undue down time for the machine. It is common to have the shank of the cutter tool to be rectangular in cross-section and to fit snugly into a mating rectangular shaped slot of the tool-box socket which is in turn fixed to the rotating drum of the mineral cutting machine. The common means of mating the shank with the socket is to locate elastomeric members in co-operating relation to slots or holes made through the broad side faces of the shank and to force fit a retainer plug of elastomeric material in the holes to protrude partially from the face of the shank. When the shank is driven into the socket the protruding part of the plug in the slot or hole in the shank deforms against the wall of the socket and there serves to hold the shank in the socket when the drum is rotated and the bits are forced against a wall of mineral material such as coal where the force of the cutting bit causes vibration of the shank in the socket. The shank and retainer combination are driven into the socket with sufficient force to prevent the shank from dislodging under the vibrations of the cutter head attacking the coal face.

DISADVANTAGE OF PRIOR ART

A disadvantage of the known retainer methods is that the retainer means are located at or near the fulcrum of the attacking pick as held and pivoted in the socket under force of cutting. The cutter operates in the plane of the broad faces of the shank, in common type cutter tools leading to excessive wear at the deformable portions of the retainer means and thereby requiring more frequent replacement of the shanks with new retainer means. When the retainers of the above described known type are used in sockets which are subject to corrosive liquids such as acids or sea salts in water the socket faces themselves become corroded resulting in a loose fit for the mating shank and the creation of 'play' of the shank in the socket thereby putting more tear and shear forces on the retainer holding the combination together. The play of the pivoting or vibrating shank in the worn socket also causes the pick to 'chatter' against the coal or rock face being cut resulting in a reduced efficiency for the cutting operation and earlier breakdown of the pick itself.

OBJECTS OF THE INVENTION

It is the object of the present invention to provide a retainer and shank combination for use in a rectangular tool-box socket wherein the retainer is set into a notched recess in the narrow face of the shank body remote from the cutting direction of the pick to maintain the point of retention of the shank in the box in the cutting plane of the pick without side forces operating to push the retainer out of co-operation with the socket and shank faces when in use.

It is the object herein to disclose a means of fitting a retainer to the shank-socket combination wherein the frictionally held retainer deformably co-acts between the shank and socket by means of ribs or corrugations that are formed in the retainer at right angles to the axial direction of the attack of the pick.

SUMMARY OF THE INVENTION

A cutter head is attached to a shank which is removeably receiveable into a rectangular socket fixed to the drum of a mineral cutting machine. The shank is removeable from the socket for replacement when the cutter head bit becomes worn or broken. A frictional elastomeric retainer is interfitted to the side of the shank remote from the direction of attack of the bit and consists of an elastomer element positioned to be predominately in a plane parallel with the longitudinal axis of the shank and frictionally operating at an angular relation to the plane of attack of the bit. The retainer element mates in dovetail mode with a notch recessed into a side face of the shank. The notch dovetail is created by inwardly recessing the corners of the notch at an angle of ninety degrees to the direction of attack of the rotating head thereby to optimize the retention capability of the notch for the retainer which is mated snugly into the notch. Where the notch sides are made by a boring operation to create a curved side surface for the notch to mate with a side-curved rounded retainer a more inexpensive shank can be made for smaller machines where less shank side surface is available.

IN THE DRAWINGS

With the foregoing in view, and such other objects, advantages or novel features as may become apparent from the consideration of this disclosure and specification, the present invention consists of the concept which is comprised, embodied embraced and included in the method, construction, composition, arrangement and combination of parts, or any new use of any of the foregoing, herein exemplified in the specific embodiments of the concept, reference being had to the accompanying drawings in which like reference numerals refer to like parts.

DESCRIPTION OF A PREFERRED EMBODIMENT OF THE INVENTION

Figure 1:
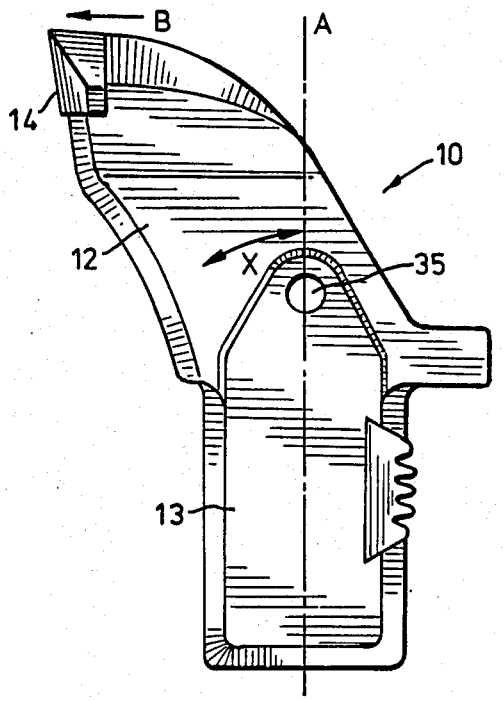
FIG. 1 is a side elevation view of the cutter tool showing the retainer member set into the notch in the side of the shank portion of the tool remote from the pick bit.
Figure 2:
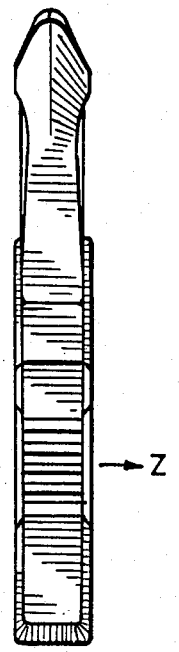
FIG. 2 is an end view of the cutter tool showing the ribs set at right angles to the axis of the shank.
Figure 3:
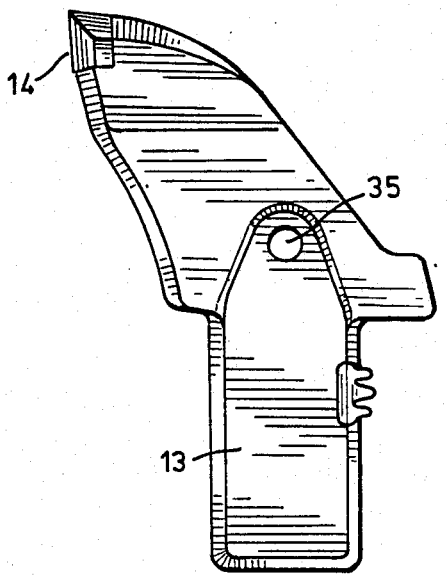
FIG. 3 shows an alternative form of retainer set into a notch with inwardly curved recesses for holding the retainer from dislodgement during use.
Figure 4:
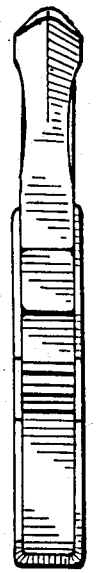
FIG. 4 is a an elevation view of the side of the alternative tool of FIG. 3.

In the drawings numeral 10 designates a cutter tool of the invention and consists of a head 12 with a contiguous shank 13 and having a cutter pick or bit member 14 fixed to the top of the head 12 and offset from the axis A—A of the shank by a degree 'X' to provide a forward attack tool for use on rotating drum type mineral cutting machines.

Figure 5:
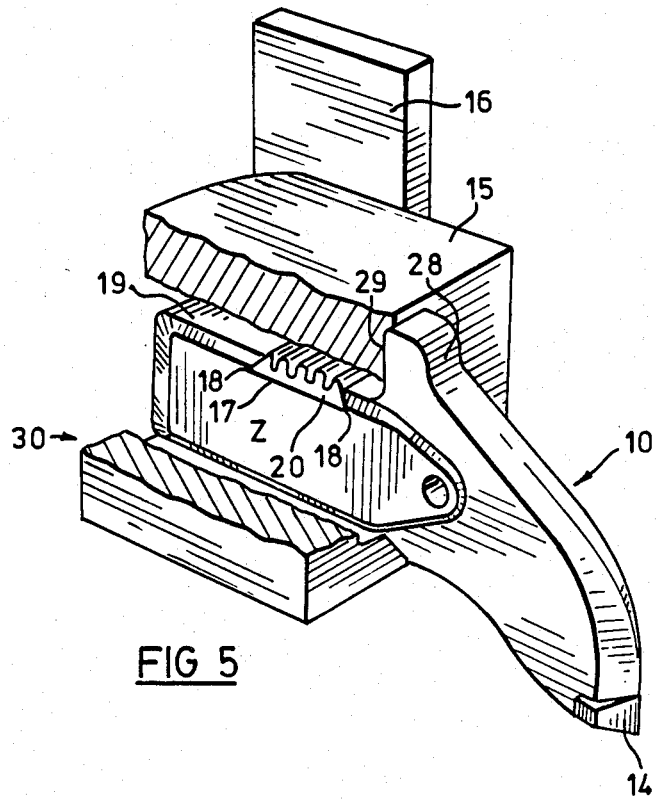
FIG. 5 is a perspective view of the cutting tool shown held in a tool-box socket partly cut away to show the retainer coacting with the sides of the socket and shank to hold them together.
Figure 6:
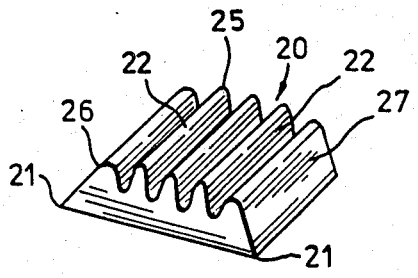
FIG. 6 is a perspective view of the retainer showing the ribs from above.

The shank 13 is held in a socket of a tool box 15 (FIG. 5) which is fixed to the drum of a rotary cutting machine by welding to a brace 16 or the like. The object is to hold the pick 14 rigid in the socket 30 of the tool-box 15 as it attacks the coal face or like mineral body with the rotary motion imparted to it by the cutter machine. The shank 13 is of rectangular shape with four side faces which mate with the four inner side faces of the socket 30 as shown in FIG. 5.

A notch or slot 17 is cut into the face 19 of the shank 13 remote from the cutter pick 14 and is recessed by sides 18,18 cut at right angles to the longitudinal axis A—A of the shank. This face 19 is directed rearwardly with respect to the advancing direction of the tool. An elastomeric retainer 20 is formed to fit snugly at its sides and bottom into the notch 17 and has outwardly tapered tapered lower edges 21,21, to mate with the recesses 18, 18 of the notch in dovetail fashion to provide a combination difficult to dislodge when in use. The notch bottom face and the mating bottom of the retainer are formed to be in parallel with a plane through the axis of the shank.

The retainer is made of an elastomeric deformable material such as polyurethane that has strong resistance to vibrational wear against the coacting faces of the socket and shank. The retainer 20 protrudes from the notch 17, and is manually removeable in a direction 'Z' from the shank when the shank has been removed from the socket. The protruding portion of the retainer 20 is corrugated or ribbed as shown. The ribs 22 project in a rearward direction at right angles to the rearwardly directed face 19 of the shank and grip the inner side of the socket 30 with a frictional force at right angles to the longitudinal axis A—A of the shank. The corrugations 22 are seen to be open ended and have rounded crowns 25 which are deformable to provide the retaining action when in use.

The opposite sides 26,27 of the retainer block 20 are inclined inwardly of the body of the block toward the protruding ribs crowns 25 to resist the vibration wear and to assist the retention of the block of the retainer in the notch during fitting of the shank in the socket. The lower ends 21,21 of the sides 26,27, dovetail into the notch recess 18,18 to provide the above retention capability.

OPERATION OF THE COMBINATION

The cutter tool 10 is manufactured in quantity for replacement into the tool-boxes 15 of the mineral cutting machine as individual picks become worn. The tools must be easily and quickly removeable and replaceable to lessen the down time of the cutter machine. The shank must also be rigid in the socket to prevent chattering of the pick in the rock face during operation. The retainer 20 must be able to be force fitted between the shank and socket without destroying the ribs and crowns. A lug 28 is shown on shank 13 and it is used to receive a blow from a hammer to drive the shank and its attached retainer down into the socket until the lug lower side 29 stops further insertion of the shank in the socket of the tool-box. There is no tendency of the retainer to slip out of the open sides of the notch and the double dovetailing of the retainer in the notch prevents dislogement of the retainer as it is forced down with the shank into the socket. The crowns 25 of the retainer 20 deform as the shank is driven into the socket and when in place coacts to maintain the parts together with maximum rigidity. A hole 35 is provided through the head of the cutter to allow insertion of an extracting tool for force removal of the shank from the socket when required.

In a preferred embodiment, the retainer 20 is 1.3 inches long with an overall height of 0.370 inches. The height of each rib 22 is 0.210 inches with the flanks of each rib inclined at an included angle of 20%. The radius of the crowns 25 are 0.046 inches and the troughs between the flanks is radiussed at 0.030 inches. The ribs at each end of the insert 20 are reduced by 0.060 inches in overall height. The sides 26, 27 are inclined at an included angle of 60° to the base. This insert fits into a notch 18 having an overall length of 1.25 inches and a depth of 0.25 inches.

VARIATIONS IN THE INVENTION AS DEPICTED IN THE DRAWINGS

The drawings show, and the aforementioned preferred embodiment describes the retainer block as being inserted into a notch on the side of the shank remote from the cutter head. It has been found that the notch can be made in the shank proximate the cutter head face and a retainer inserted there also for a useful and novel operational device. Where particularly effective retention power of a shank in a tool-box is desired a notch can be made in both the proximate and remote forward and leading edges of the shank in respective to the attacking plane of the cutter head and a retainer means fitted into both notches; that is use of two retainers is contemplated as a variation of the device.

Where the inner side corners of the tool box socket are rounded as in machining, to provide more snug fit for the shank it has been found preferrable to make the retainer block narrower than the the side face of the shank notch to thereby insure that the rounded corner does not deform and destroy the corners of the crowns of the block corrugations during the force fitting of the retainer block and shank into the socket.

I claim:

1. A tool for use in the socket of a forward-attack toolholder said tool comprising:

a head portion, said head portion having a pick in the forwardly directed end thereof with respect to the advancing direction of the tool;

a shank receivable in said socket, said shank having a rearwardly directed face with respect to the advancing direction of the tool; and frictional retainer means deformably coacting between said shank and said socket, said retainer means embodying a corrugated elastomeric element located on the rearwardly directed face of said shank the direction of projection of the corrugations of said element being at right angles to the rearwardly directed face of said shank.

2. The invention according to claim 1, in which said element is mounted on said shank and is removable from the shank in a direction parallel to the rearwardly directed face of said shank.

3. The invention according to any of the foregoing claims wherein said element comprises a rectangular elastomeric block having a set of deep, open ended and parallel corrugations on one side thereof, the two opposite sides of said block which are parallel with said corrugations inclining from the surface of said block which is opposite to the surface containing said corrugations, towards each other.

* * * * *